US010265716B2

(12) United States Patent
Lee

(10) Patent No.: US 10,265,716 B2
(45) Date of Patent: Apr. 23, 2019

(54) AIRBRUSH

(71) Applicant: YA-MAN LTD., Tokyo (JP)

(72) Inventor: Jun Hee Lee, Gyeonggi-do (KR)

(73) Assignee: YA-MAN LTD., Tokyo (JP)

( * ) Notice: Subject to any disclaimer, the term of this patent is extended or adjusted under 35 U.S.C. 154(b) by 3 days.

(21) Appl. No.: 15/126,301

(22) PCT Filed: Oct. 28, 2014

(86) PCT No.: PCT/KR2014/010162
§ 371 (c)(1),
(2) Date: Sep. 15, 2016

(87) PCT Pub. No.: WO2016/068352
PCT Pub. Date: May 6, 2016

(65) Prior Publication Data

US 2017/0225184 A1 Aug. 10, 2017

(51) Int. Cl.
*B05B 11/06* (2006.01)
*B05B 7/12* (2006.01)
(Continued)

(52) U.S. Cl.
CPC ..... *B05B 11/06* (2013.01); *B05B 7/12* (2013.01); *B05B 7/1209* (2013.01);
(Continued)

(58) Field of Classification Search
CPC ... B05B 11/06; B05B 11/061; B05B 11/0008; B05B 11/001; B05B 11/0013; B05B 11/0016; B05B 7/2416; B05B 7/2418; B05B 7/2435; B05B 7/247; B05B 7/2491; B05B 7/1209; B05B 7/1227; B05B 11/0044; B05B 7/2478; B05B 7/00–7/32; B05B 12/002
USPC ..... 239/346, 319, 353, 86, 407, 408, 409, 239/416.5, 417.3, 418, 423, 424, 340, 239/345, 351, 354, 355, 369, 371, 375
See application file for complete search history.

(56) References Cited

U.S. PATENT DOCUMENTS 5,088,903 A 2/1992 Tomatsu
7,246,755 B2 7/2007 Hornsby et al.
(Continued)

FOREIGN PATENT DOCUMENTS

CN 1689706 A 11/2005
CN 201791620 U 4/2011
(Continued)

OTHER PUBLICATIONS

Examination Report dated Dec. 15, 2017 in AU Application No. 2014409667.
(Continued)

*Primary Examiner* — Christopher Kim
*Assistant Examiner* — Juan C Barrera
(74) *Attorney, Agent, or Firm* — Panitch Schwarze Belisario & Nadel LLP

(57) ABSTRACT

An airbrush that sprays liquid in a mist form. A supply of a compressed air and a supply of the spray liquid can be controlled at the same time only using a spray button included in a spray head. Accordingly, a loss of the spray liquid can be minimized, the airbrush can be maintained clean, and usability of the airbrush can be enhanced.

11 Claims, 9 Drawing Sheets

(51) Int. Cl.

| | |
|---|---|
| ***B05B 7/24*** | (2006.01) |
| ***B05B 12/00*** | (2018.01) |
| ***B05B 11/00*** | (2006.01) |

(52) U.S. Cl.

CPC ..... *B05B 7/2416* (2013.01); *B05B 7/2435* (2013.01); *B05B 11/0044* (2018.08); *B05B 12/002* (2013.01); *B05B 7/247* (2013.01); *B05B 7/2478* (2013.01)

(56) References Cited

U.S. PATENT DOCUMENTS

| | | | | |
|---|---|---|---|---|
| 2012/0067977 | A1* | 3/2012 | Spiegel | B05B 7/068 239/337 |
| 2014/0209702 | A1* | 7/2014 | Weng | B05B 17/0638 239/74 |

FOREIGN PATENT DOCUMENTS

| | | | |
|---|---|---|---|
| CN | 201807481 | U | 4/2011 |
| CN | 102601008 | A | 7/2012 |
| CN | 102755940 | A | 10/2012 |
| CN | 102885689 | A | 1/2013 |
| EP | 2548653 | A1 | 1/2013 |
| JP | 2012179518 | A | 9/2012 |
| KR | 200358746 | Y1 | 8/2004 |
| KR | 20120122188 | A | 11/2012 |
| KR | 20130057342 | A | 5/2013 |
| KR | 101277554 | B1 | 6/2013 |

OTHER PUBLICATIONS

Int'l Search Report dated Jul. 15, 2015 in Int'l Application No. PCT/KR2014/010162.

Extended European Search Report dated May 30, 2018 in EP Application No. 14904972.8.

Office Action dated Feb. 5, 2018 in CN Application No. 201480077702.8.

* cited by examiner

AIRBRUSH

CROSS-REFERENCE TO RELATED APPLICATION

This application is a Section 371 of International Application No. PCT/KR2014/010162, filed Oct. 28, 2014, which was published in the Korean language on May 6, 2016, under International Publication No. WO 2016/068352 A1, and the disclosure of which is incorporated herein by reference.

TECHNICAL FIELD

The present invention relates to an airbrush of spraying a spray liquid with a mist type. The airbrush of the present invention is easy to carry and operate, and a spray head can be easily selected, replaced, and used according to a kind of a spray liquid in the airbrush of the present invention.

BACKGROUND ART

A material, a paint, and so on used for beauty treatments, such as, a foundation, a sunblock for preventing ultraviolet, a moisturizer, and so on, is often used as a mist type in which fine particles are sprayed and dispersed in air, instead of a direct applying on a skin, in order to enhance effects of the material, the paint, and so on or an absorptiveness.

An apparatus for spraying a material with a mist type is generally called an airbrush. A structure and a genetic principal of the airbrush are very diverse.

For example, in an apparatus for spraying a cosmetic product (or a tonic) stated in Japanese Utility Publication No. 3096966 (hereinafter, referred to as 'Prior Art 1'), an ultrasonic vibrator is used to spray the tonic with the mist type.

However, in the case that the ultrasonic vibrator is used to spray the cosmetic product with the mist type, when a cosmetic product having high viscosity, such as, an essence, or a cosmetic product where solid powders are mixed, such as, a foundation, is used, fine openings of a nozzle are often blocked, or sizes of particles of the mist are not uniform and thus an applying state of the cosmetic product is poor even though the mist is generated.

In a spraying device stated in International Laid-open Patent Publication No. WO2011112246 (hereinafter, referred to as 'Prior Art 2'), a liquid is sprayed with a mist type by a flow of a compressed air. Thus, unlike Prior Art 1, a liquid having high viscosity or a liquid where solid powders are mixed can be spray with a mist type. However, an air-supply module for supplying the compressed air is a separated portion from a spraying portion. Thus, a portability of the spraying device is not good.

Also, in Prior Art 2, a switch for operating the air-supply module and a lever for supplying the liquid to the spray hole and for spraying the liquid with the mist type are separated from each other. Accordingly, an operability of the spraying device is low.

DETAILED DESCRIPTION OF THE INVENTION

Technical Problem

An embodiment of the present invention has been made to provide an airbrush being easy to carry.

Also, an embodiment of the present invention has been made to provide an airbrush being easy to operate.

Further, an embodiment of the present invention has been made to provide an airbrush being able to easily replace a spray liquid on purpose.

Technical Solution

According to an aspect of the invention, an airbrush is provided. The airbrush includes an air-supply module including a battery, an air-supply unit for discharging a compressed air when electric power is supplied, and a switch for supplying or blocking the electric power of the battery to the air-supply unit; and a spray head having a spray bole at one side of the spray head and detachably coupled to the air-supply module. The spray head includes: a storage tank for storing a spray liquid; a needle valve for discharging or blocking the spray liquid stored in the storage tank to a discharging hole formed at the spray hole; a valve frame for supporting the needle valve, wherein the valve frame including an air-supplying passage where the compression air flows and an orifice member being adjacent to the discharging hole and for spraying or sporting the compressed air that penetrated through the air-supplying passage to the spray hole; and a trigger for operating the needle valve and the switch at the same time.

The air-supply module may further include: a circuit hoard electrically connected to the air-supply unit, the battery, and the switch; and a lighting member including a light emitting device electrically connected to the circuit board and disposed at a side of the airbrush where the spray hole is formed, wherein the light emitting device being turned on or off according to an operation of the switch.

In this instance, the air-supply module may further include: a connector electrically connected to the circuit board, wherein a jack supplying charging electric power and being detachably coupled to the connector; a charging circuit disposed at the circuit board, wherein the charging circuit for supplying the charging electric power to the battery to charge the battery; and a charging lamp electrically connected to the circuit board and displaying a charging state of the battery by the charging circuit.

The air-supply module may include: an upper cover for covering an upper side of the air-supply module; and a connection pipe, wherein an end portion of the connection pipe being connected to the air-supply unit and the other end portion of the connection pipe penetrating through the upper cover and being exposed to as upper side of the air-supply module. The upper cover has an operation hole where a lower portion of the trigger may be inserted. The switch may be adjacent to the operation hole and an operation of the switch may be determined according to a depth of the trigger inserted into the operation hole.

The needle valve may include: a needle, wherein a diameter of the needle decreasing at one side of the needle toward an end portion of the needle; and a valve sheet having the discharging hole, wherein the one side of the needle being inserted and supported in the discharging hole. The spray head may include: a head frame for movably supporting the trigger in upward and downward directions and for supporting the valve frame, wherein an air-supplying pipe for allowing the compressed air to flow to the air-supplying passage protruding from the head frame in a downward direction; a needle holder where the other side of the needle is fixed, wherein the needle holder movably coupled to the valve frame in a direction parallel to a longitudinal direction of the needle and having a hooking projection; an elastic member for elastically supporting the needle holder in a direction toward the spray hole; and a holder-operating member including a rotation axis, a lever for connecting the rotation axis and the trigger, and a hooked recess connected to the hooking projection, wherein both ends of the rotation axis being rotatably supported by the head frame, wherein the needle holder moving in the longitudinal direction of the needle when the trigger moves in upward and downward directions.

In this instance, the spray head may further include: a head cover for covering the head frame, the valve frame, the storage tank, and the trigger.

Also, the spray head may further include: a separation button of the spray head and the air-supply module, wherein an upper side of the separation button penetrating through an outer circumference surface of the head cover and being exposed to an outside and a lower side of the separation button including a fastening hook; and a button-supporting member disposed inside the head cover and elastically supporting the separation button so that the upper side of the separation button is exposed to the outside of the outer circumference surface of the head cover. A fastening hole may be formed at an upper side of the air-supply module to correspond to the fastening hook.

In addition, a hooking protrusion may foe formed at an outer circumference surface of the head cover. The spray head may further include: a spray button coupled to an upper end of the trigger or formed at the upper end portion of the trigger; and a protection cap for covering the spray hole and the spray button, wherein the protection cap being detachably coupled to the spray head and having a hooked recess corresponding to the hooking protrusion at an inner circumference surface of the protection cap.

Further, an inlet where the spray liquid is injected may formed at an upper side of the storage tank, the spray head may further include an inlet cover for openably covering the inlet, and the inlet cover may have at least one vent hole.

In this instance, the inlet cover may be formed of an elastic material, and one side of the inlet cover may be coupled to the head cover. Selectively, a pin hole may be formed at the upper side of the storage tank. The spray head may further include a rotation-supporting pin rotatably inserted into the pin hole, and a cover body covering the inlet and having at least one vent hole.

Also, an injection hole where the injection liquid is injected and a pin hole may be formed at the upper side of the storage tank. The spray head further includes a rotation-supporting pin rotatably inserted into the pin hole, and an inlet cover including a cover body, wherein the cover body covering the inlet and having at least one vent hole.

The above-mentioned airbrush may further includes: a cradle including a mounting recess having a shape corresponding to a lower end portion of the air-supply module and supporting the air-supply module upright.

Advantage Effect

According to an embodiment of the present invention, an air-supply module can be operated by electric power of a battery which is embedded, and thus, potability of an airbrush can be enhanced.

Also, according to an embodiment of the present invention, a supply of a compressed air and a supply of a spray liquid can be controlled at the same time only using the spray button included in a spray head. Thus, an operation of an airbrush can be easy, and the spray liquid can be prevented from being leaked through a spray hole. Accordingly, a loss of the spray liquid can be minimized and the airbrush can be maintained clean.

In addition, according to an embodiment of the present invention, an air-supply module for supplying a compressed air and a spray head for storing the spray liquid can be easily replaced and can be easily coupled to each other. A spray liquid among various kinds of spray liquids can be easily selected and used on purpose, and thus, usability of the airbrush can be enhanced.

MODE OF THE INVENTION

Certain embodiments are shown in drawings and will be described since various modifications are possible and various embodiments are possible in the invention. However, the present is not limited to the certain embodiments. The invention should be understood to include modifications, equivalents, and substitutes in a technical scope and spirit of the invention. The detailed descriptions of the prior art will be omitted when the detailed descriptions of the prior art confuses the technical feature of the present invention.

Hereinafter, with reference to accompanying drawings, an embodiment of the invention will be described in detail.

Figure 1:
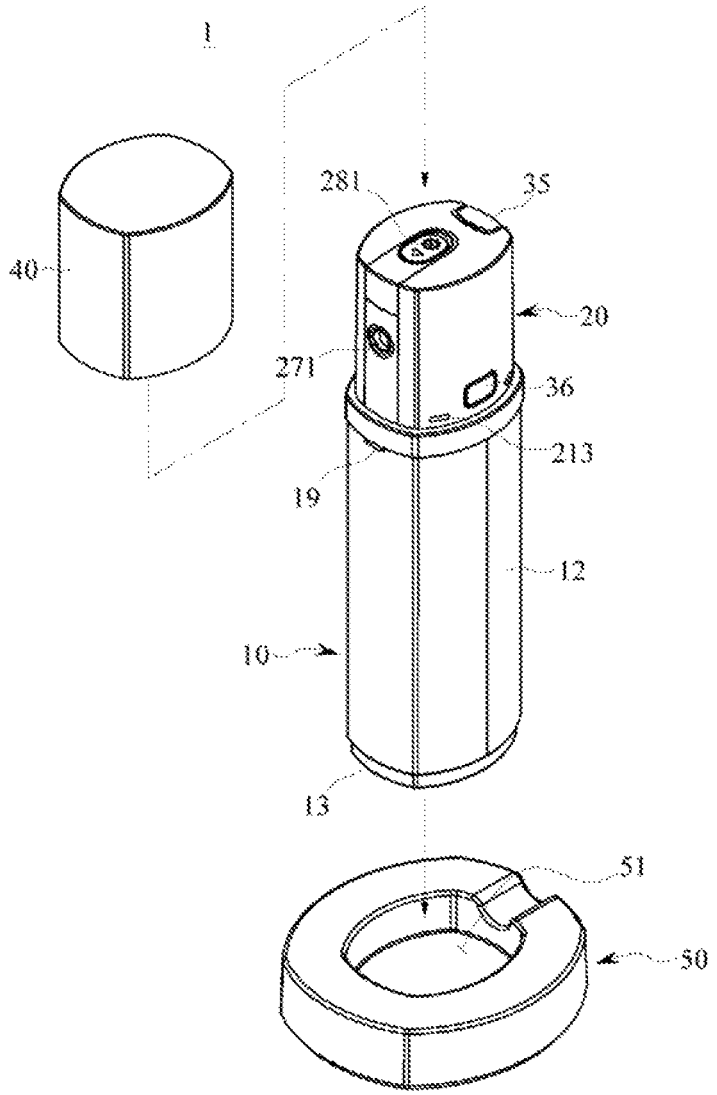
FIG. 1 is a perspective view of an airbrush according to an embodiment of the present invention.
Figure 2:
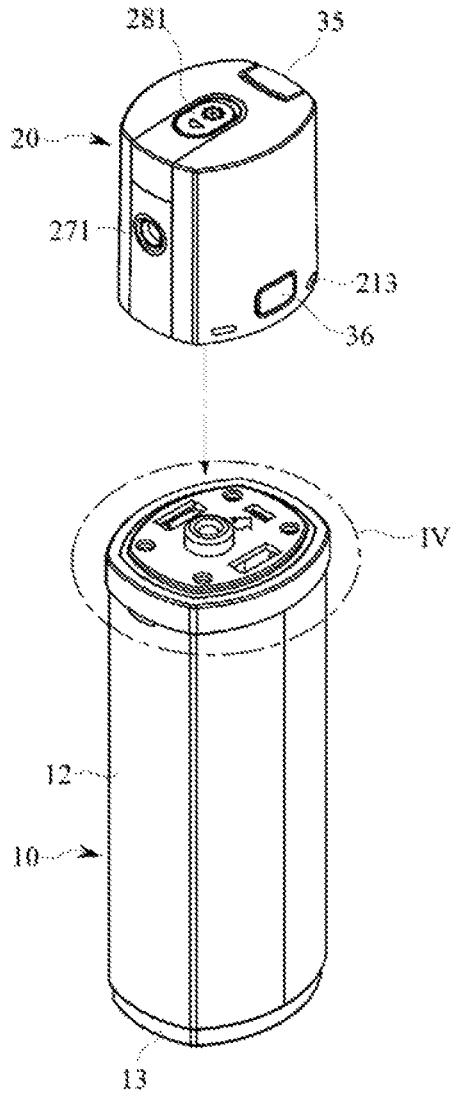
FIG. 2 is a perspective view of an air-supply module and a spray head shown in FIG. 1.

FIG. 1 is a perspective view of an airbrush according to an embodiment of the present invention, and FIG. 2 is a perspective view of an air-supply module and a spray head shown in FIG. 1.

With reference to FIG. 1, an airbrush 1 according to an embodiment of the present invention may include an air-supply module 10, a spray head 20, a protection cap 40, and a cradle 50.

The protection cap 40 covers the spray head 20 and may be detachably coupled to the spray head 20. A lower portion of the air-supply module 10 where a lower cover 13 is coupled is mounted on a mounting recess (or a mounting hole) 51 formed at the cradle 50, and the air-supply module 10 can be mounted upright.

With reference to FIG. 2, the air-supply module 10 and the spray head 20 are detachably coupled to each other. In this instance, the air-supply module 10 and the spray head 20 may be separated from each other only when a separation button 36 is pressed in order to prevent an undesirable separation of the air-supply module 10 and the spray head 20. This will be described later with reference to FIG. 4 and FIG. 5.

Figure 3:
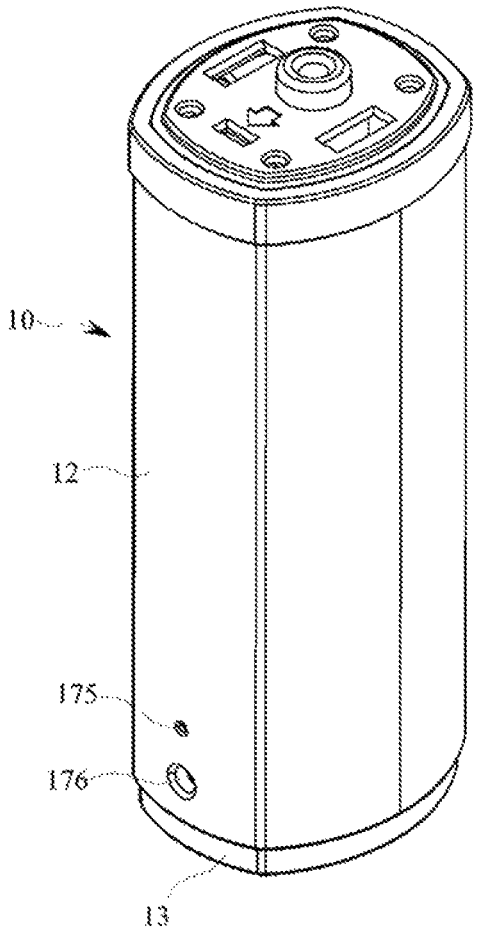
FIG. 3 is a perspective view of the air-supply module in FIG. 1 when viewed from another direction.

FIG. 3 is a perspective view of the air-supply module in FIG. 1 when viewed from another direction.

With reference to FIG. 3, the air-supply module 10 includes an air-supply module frame 12 for forming an outer circumference surface of the air-supply module 10. An connector 176 and a charging lamp 175 are mounted in the air-supply module frame 12 so that the connector 176 and the charging lamp 175 are exposed to an outside. If will be described later with reference to FIG. 6.

Figure 4:
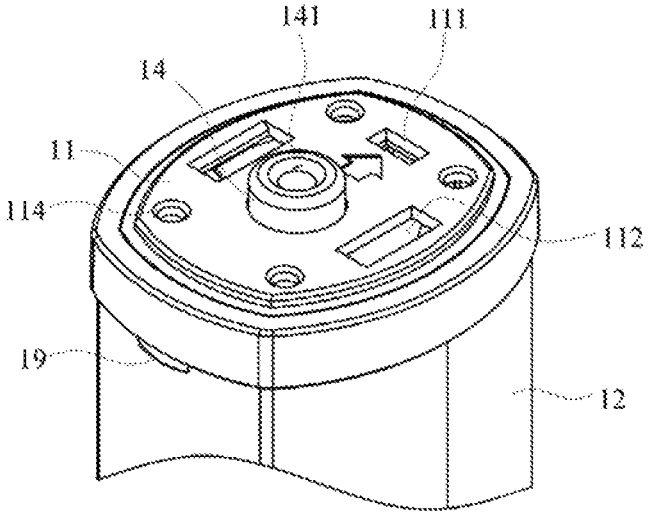
FIG. 4 is an enlarged view of an IV portion of FIG. 2.

FIG. 4 is an enlarged view of an IV portion Of FIG. 2. The air-supply module 10 will be described with reference to FIG. 4, along with FIG. 1.

With reference to FIG. 1 and FIG. 4, the air-supply module 10 includes an upper cover 11 disposed on an upper side and forming an outer shape of the upper side, the air-supply module frame 12, and a lower cover 13 disposed on a lower side and forming an outer shape of the lower side.

A operation hole 111, a fastening hole 112, a protrusion-supporting hole (or a plurality of protrusion-supporting holes) 114 are formed at the upper cover 11, and a connection pipe 14 is formed at an intermediate portion between the operation hole 111, the fastening hole 112, and the protrusion-supporting hole 114 to penetrate through the upper cover 11.

A coupling hole 141 is formed at a central portion of the connection pipe 14, and a lighting member 19 is mounted on the air-supply module frame 12 so that the lighting member 19 is exposed to an outside. This will be described later with reference to FIG. 6.

Figure 5:
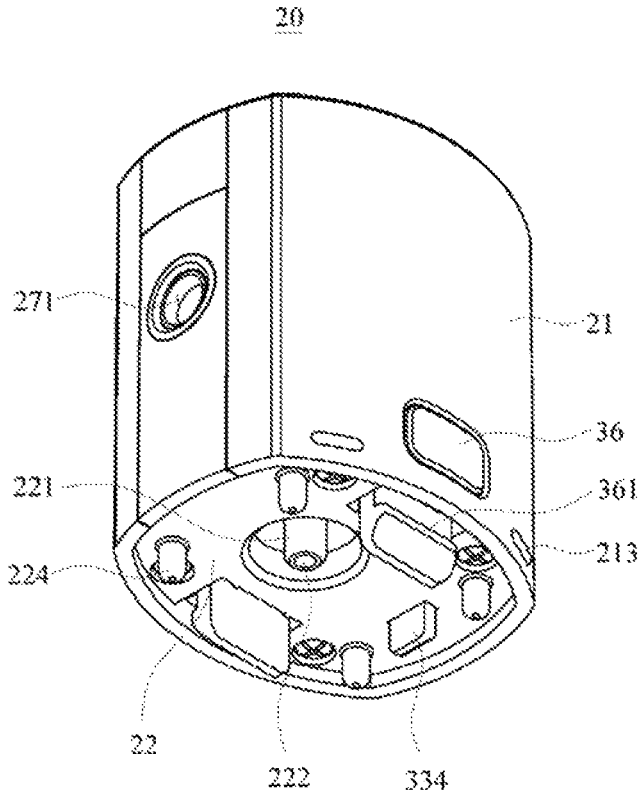
FIG. 5 is a bottom perspective view of the spray head shown in FIG. 1.

FIG. 5 is a bottom perspective view of the spray head shown in FIG. 1.

With reference to FIG. 5, the spray head 20 includes a head cover 21, a head frame 22, and a separation button 36. The head cover 21 forms van outer shape of a lateral side and an upper side of the spray head 20, and a bottom surface of the head frame 22 forms an Outer shape of a lower side of the spray head 20.

A spray hole 271 is formed at one side of the head frame 22. A hole is formed at a portion of the head frame 22 where the separation button 36 is disposed, and an upper side of the separation button 36 is exposed to an outer circumference surface of the head frame 22.

The upper side of the separation button 36 is a portion where an user presses the separation button 36, and the portion of the separation button 36 exposed to the outside of the head cover 21 has a planar surface or a curved surface to correspond to the outer circumference surface of the head cover 21 as shown in drawings. Although it is not shown, the separation button 36 may protrude than the head cover 21, if necessary. Also, a fastening hook 361 is formed at a lower side of the separation button 36.

Even though it is not shown, a button-supporting member is disposed inside the head cover 21, and the button-supporting member elastically supports the separation button 36 in a direction so that the upper side of the separation button 36 is exposed to the outer circumference surface of the head cover 21. Therefore, when the user presses the upper portion of the separation button 36, the separation button 36 may be pressed toward a central portion of the head cover 21. When the user removes the force applied to the upper side of the separation button 36, the separation button 36 goes back to its original position.

For the above operation, the button-supporting member (not shown in the drawings) may include a spring or so on. The fastening hook 361 may also move toward the central portion of the head cover 21 or go back to its original position according to the press and the recovery of the separation button 36.

With reference to FIG. 4 and FIG. 5, the fastening hole 112 and the fastening hook 361 are arranged to correspond to each other.

Therefore, as shown in FIG. 2, when the spray head 20 is coupled to the air-supply module 10, the fastening hook 361 is inserted into the fastening hole 112, and the fastening hook 361 inserted into the fastening hole 112 is fastened to an edge of the fastening hole 112 by an elastic support of the button-supporting member (not shown in drawings). Thereby, an undesirable separation of the spray head 20 from the air-supply module 10 can be prevented.

In order to separate the air-supply module 10 and the spray head 20 that are coupled to each other, the separation button 36 is pressed to move toward the central portion of the spray head 20, and then, the end of the fastening hook 361 is separated from the edge of the fastening hole 112. Thereby, the fastening hook 361 can be easily separated from the fastening hole 112.

For reference, as shown in drawings, the fastening hook 361 has an inclined surface inclined in one direction is formed. Thus, if a force is applied to the spray head 20 in a downward direction after the bottom surface of the spray head 20 disposed or mounted on the upper side of the air-supply module 10, the fastening hook 361 is inserted into the fastening hole 112. Then, the spray head 20 and the air-supply module 10 can be easily coupled to each other without pressing the separation button 36.

An air-supplying pipe 221 is formed at the head frame 22 to protrude outside in a downward direction, and an air-supplying hole 222 is formed at a central portion of the air-supplying pipe 221. A supporting protrusion (supporting protrusions) 224 protrudes in a downward direction at a peripheral portion of the head frame 22.

The protrusion-supporting hole 114 formed at the upper cover 11 is formed at a position corresponding to a position of the supporting protrusion 224. When the head frame 22 is disposed or mounted on the upper cover 11, the head frame 22 can be positioned at the predetermined position and the state that the spray head 20 can be stably coupled to the air-supply module 10 can be maintained by the protrusion-supporting hole 114 and the supporting protrusion 224.

On the other hand, the air-supplying pipe 221 and the connection pipe 14 are disposed to correspond to each other. When the spray head 20 may be coupled to the air-supply module 10, the air-supplying pipe 221 can be inserted into the coupling hole 141. Selectively, although it is not shown, the connection pipe 14 may be inserted into the air-supplying hole 222.

Therefore, the air-supplying hole 222 and the coupling hole 141 are communicated with each other. An outer diameter of the air-supplying pipe 221 corresponds to or is the same as an inner diameter of the coupling hole 141, or an inner diameter of the air-supplying hole 222 corresponds to or is the same as an outer diameter of the connection pipe 14. Then, when the air-supplying pipe 221 and the connection pipe 14 are coupled, air tightness can be maintained.

The hooking protrusion 213 formed at the outer circumference surface of the head cover 21 is for preventing the undesirable separation of the protection cap 40 from the spray head 20. Although it is not shown, a hooked recess (or a hooked hole) is formed at an inner circumference surface of the protection cap 40 at a position corresponding to a position of the hooking protrusion 213. A number of the fastening groove is the same as a number of the hooking protrusion 213. Then, when the protection cap 40 is coupled to the spray head 20, the hooking protrusion 213 is inserted into the hooked recess (not shown in drawings).

Therefore, the protection cap 40 can be separated from the spray head 20 by applying a suitable force in the state that the protection cap 40 is coupled to the spray head 20.

The air-supplying-operation protrusion 334 penetrates through the head frame 22 and protrudes in a downward direction. The air-supplying-operation protrusion 334 is formed at a position corresponding to a position of the operation hole 111. When the spray head 20 and the air-supply module 10 are coupled, the air-supplying-operation protrusion 334 is inserted into the operation hole 111.

For reference, a reference numeral 35 in FIG. 1 is a spray button. An operation of the spray button 35 and the air-supplying-operation protrusion 334 will be described later with reference to FIG. 7 to FIG. 10.

Figure 6:
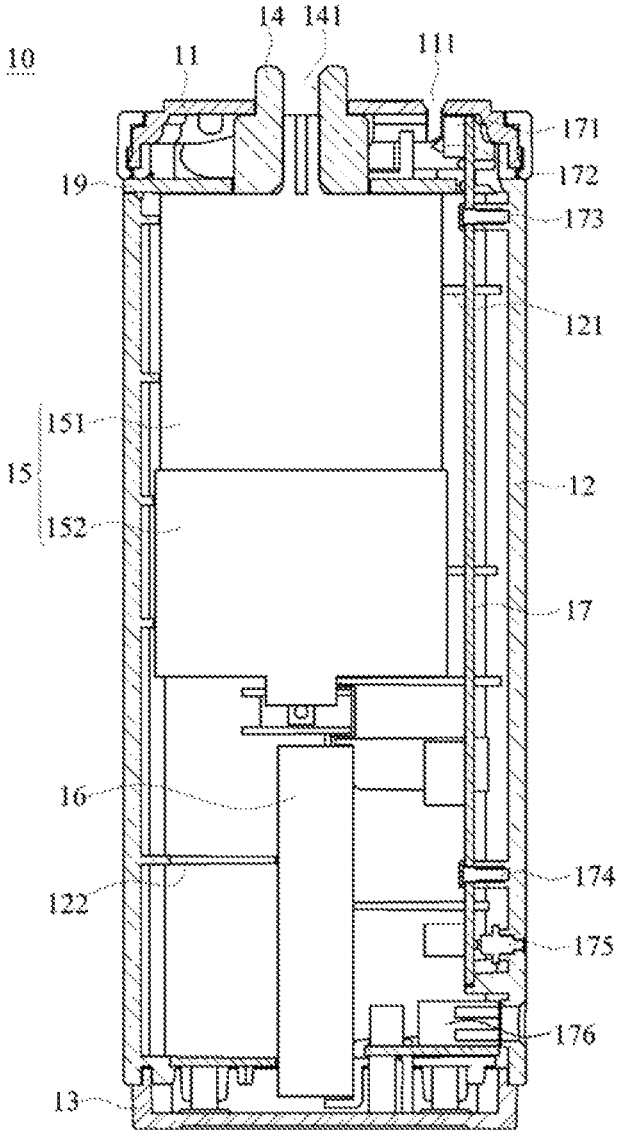
FIG. 6 is a longitudinal cross-section view of the air-supply module shown in FIG. 1.

FIG. 6 is a longitudinal cross-section view of the air-supply module shown in FIG. 1.

With reference to FIG. 6, the air-supply module 10 includes the upper cover 11, the air-supply module frame 12, the lower cover 13, the connection pipe 14, an air-supply unit 15, a battery 16, a circuit board 17, a switch 171, fixing members 173 and 174, the charging lamp 175, the connector 176, and the lighting member 19.

In this instance, the upper cover 11, the air-supply module frame 12, the lower cover 13, and the connection pips 14 were described with reference to FIG. 1 to FIG. 5, and thus, the descriptions thereof will be omitted.

The air-supply unit 15 may include an air pump 151 and a motor 152, and the switch 171 may include a driving button 172. The air pump 151 inhales a circumferential air and generates a compressed air when a driving force is supplied. The motor 152 generates the driving force when the electric power is supplied.

Since the air pump 151 and the motor 152 are well-known, the descriptions of the air pump 151 and the motor 152 will be omitted. Various air-supply units are applied to the air-supply unit 15 regardless of operating methods, if the air-supply unit 15 can receive the electric power and thus provide the compressed air.

However, as fluctuation of an amount of the compressed air decreases, uniformity of particles of mist generated by the compressed air discharged from the air pump 151 increases. Thus, the air pump 151 having small fluctuation of the compressed air discharged during the operation of the air pump 151 may be selected and used.

For reference, in this specification, the compressed air indicates an air discharged from the air pump 151 for convenience. In order to transfer the air discharged from the air pump 151 along the predetermined passage, it is clear that the air discharged from the air pump 151 has a pressure higher than atmosphere pressure. Thus, both of the air that is discharged from the air pump 151 and is not actually compressed and the air that is discharged from the air pump 151 and is actually compressed are the compressed air in this specification.

A secondary ceil being able to be recharged may be used as the battery 16. As necessary, a primary cell may be used as the battery 16.

For example, a secondary cell may be used as the battery 16. However, in a situation of mountain climbing, an outback exploration, and so on, it may be difficult to earn power for charging the secondary cell. Therefore, in the situation, a primary cell may be used as the battery 16. The battery 16 can be easily replaced in the stated that the lower cover 13 is separated from the air-supply module frame 12.

A supporting rib (or a plurality of supporting ribs) 121 is formed at and is protruded from an inner side surface of the air-supply module frame 12, or the supporting rib 121 is manufactured by a separated process and is coupled to the air-supply module frame 12. The supporting rib 121 supports the air-supply unit 15 and the battery 16.

The circuit board 17 is for controlling an operation of the airbrush (the reference numeral 1 of FIG. 1) according to an embodiment of the invention. The circuit board 17 may be fixed and mounted in the air-supply module frame 12 by the fixing means 173 and 174.

The motor 152, the battery 16, the switch 171, the charging lamp 175, the connector 176, and the lighting member 19 among the air-supply unit 15 are electrically connect to the circuit board 17, respectively.

The switch 171 supplies or blocks the electric power of the battery 16 to the electric power of the motor 51 of the air-supply unit 151.

The switch 171 includes the driving button 172. When the driving button 172 is pressed, the electric power of the battery 16 is supplied to the air-supply unit 151 and the compressed air is discharged. When the driving button 172 is not pressed and thus the driving button 172 goes back to its original position, the electric power that is supplied to the air-supply unit 151 is blocked and the operation of the air-supply unit 151 is stopped.

The switch 171 may fee disposed to be adjacent to the operation hole 111 formed at the upper cover 11. According to a degree that the above-mentioned air-supplying-operation protrusion 334 is inserted into the operation hole 111, the driving button 172 may be pressed or may be not pressed. This will be described in detail later with reference to FIG. 7 to FIG. 10.

The connector 176 connected to the circuit board 17 is for providing charging electric power supplied from an outside of the air-supply module 10. A jack (not shown in drawings) where the charging electric power is supplied may be detachably coupled to the connector 176.

Although it is not shown, a charging circuit may be included in the circuit board 17.

When a secondary cell is used as the battery 16 and the battery 16 is discharged and is necessary to be charged, the user may connect the jack (not shown in drawings) where the charging electric power is supplied to the connector 176. Thereby, the charging electric power is supplied to the circuit board 17 through the connector 176, the charging circuit allows the charging electric power to be supplied to the battery 16 and the battery 16 is charged.

During the battery 16 is being charged, the charging lamp 175 turns on. Thus, the user can recognize the fact that the battery 16 is being charging.

In addition, after the completion of charging of the battery 16, the charging circuit blocks the supply of the charging electric power to the battery 16, and also, turns on the charging lamp 175 with a color different form the color while the battery 16 is being charging or turns off the charging lamp 175 in order to prevent overcharge. Thus, the user can easily recognize the charging state of the battery 16.

For reference, when the battery 16 is being charged or the airbrush (the reference number of FIG. 1) is not used, the lower side of the air-supply module 10 is disposed or mounted on the mounting recess 51 of the cradle 50 and is maintained upright. Thus, the user can easily recognize the charging state of the airbrush 1, and the user can easily hold or grasp the air-supply module 10 when the user use the airbrush 1 again.

The lighting member 19 includes a light emitting device (not shown in drawings), such as a light emitting diode, that emits light when electric power is supplied. As shown in FIG. 1, the light emitting device (not shown in drawings) is disposed at a side where the spray hole 271 is formed.

When the driving button 172 of the switch 171 is pressed, the electric power of the battery 16 is supplied to the light emitting device (not shown in drawings) included in the lighting member 19 through the circuit board 17 and thus the light emitting device (not shown in drawings) turns on. When the driving button 172 of the switch 171 is not pressed, the light emitting device (not shown in drawings) turns off.

According to the light generated when the light emitting device (not shown in drawings) of the lighting member 19 turns on, the user of the airbrush 1 can check whether the airbrush 1 operates or not, and also, the user can check whether the mist is coated on the intended position or not or check the state of the mist that is coated on the intended position.

Figure 7:
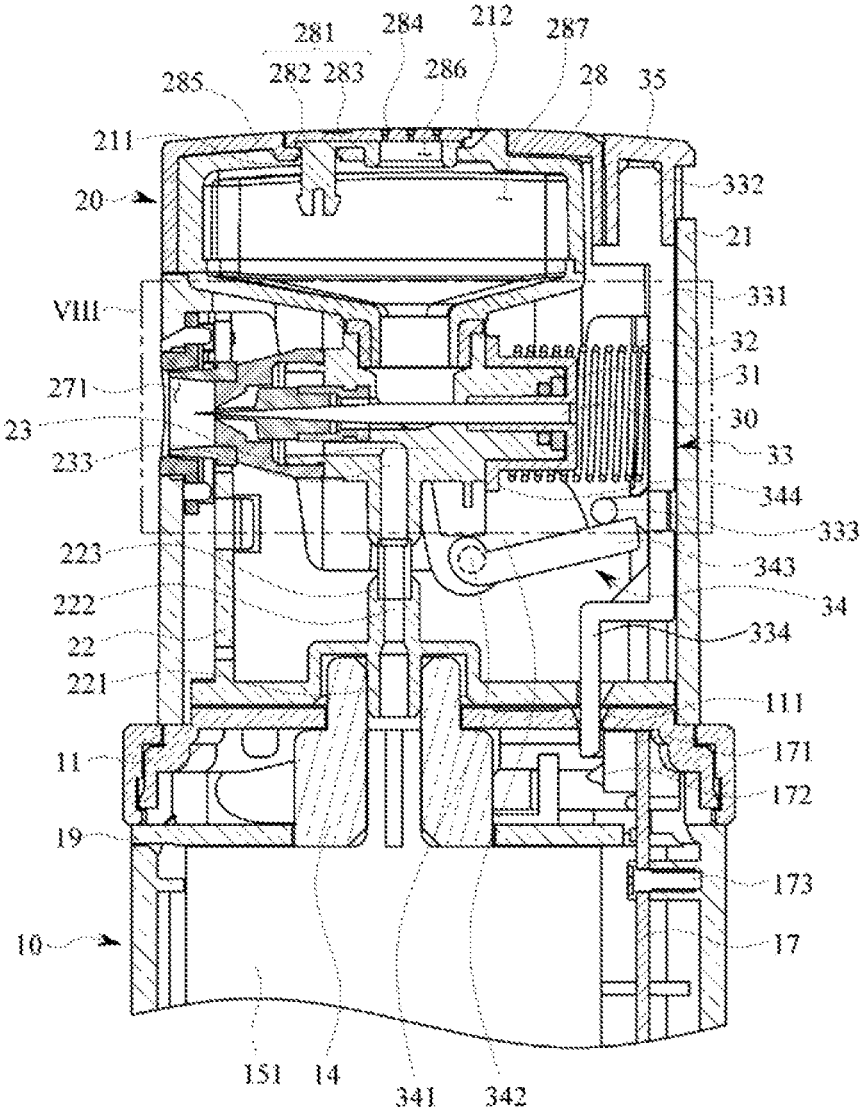
FIG. 7 is a longitudinal cross-section view of a part of the air-supply module and the spray head when the airbrush shown in FIG. 1 does not operate.
Figure 8:
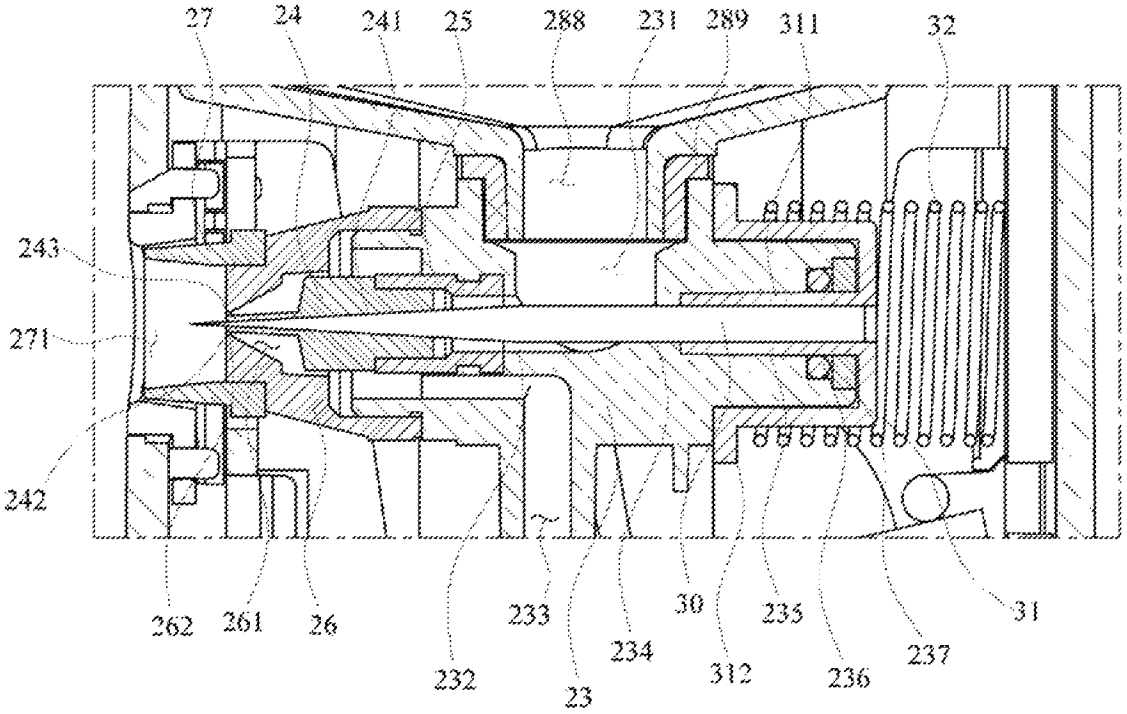
FIG. 8 is an enlarged view of a VIII portion of FIG. 7.

FIG. 7 is a longitudinal cross-section view of a part of the air-supply module and the spray head when the airbrush shown in FIG. 1 does not operate, and FIG. 8 is an enlarged view of a VIII portion of FIG. 7. The airbrush 1 will be described with reference to both of FIG. 7 and FIG. 8.

With reference to FIG. 7 and FIG. 8, the spray head 20 includes a storage tank 28, a valve frame 23, a needle holder 31, an elastic member 32, a trigger 33, a holder-operating member 34, a spray button 35, and so on, along with the head cover 21 and the head frame 22 described with reference to FIG. 5.

The head frame 22 is disposed or mounted on an upper side of the upper cover 11 when the air-supply module 10 and the spray head 20 are coupled to each other. In this instance, as stated in the above, the lower side of the air-supplying pipe 221 may be inserted into the coupling hole 141 of the connection pipe 14.

The air-supplying pipe 221 protrudes than the head frame 22 in an upward direction. The air-supplying hole 222 is formed from a lower end portion of the air-supplying pipe 221 to an upper end portion of the air-supplying pipe 21 along a longitudinal direction of the air-supplying pipe 221.

The valve frame 23 is disposed on the upper side of the head frame 22 and is supported by the head frame 22. The valve frame 23 includes a valve sheet 24, a valve sheet holder 25, a spray cap 26, a spray ring 27, and a needle 30.

The spray ring 27 is a member of a ring shape having a spray hole 271 at a center. A diameter of the spray hole 271 and a shape of an inner circumference surface of the spray hole 271 may be varied according to conditions, such as, an area where the mist is coated, a degree (or a distance) that the mist diffuses when the mist is sprayed, and so on.

For example, in the case that the mist sprayed from the spray hole 271 of the airbrush (the reference numeral 1 of FIG. 1) should be coated with a large area, a diameter of the spray hole 271 may foe sufficiently large. In the case that a density of the mist sprayed from the spray hole 271 is low, an inner circumference surface of the spray hole 271 is inclined so that an inner diameter of the spray hole 271 increases as it goes toward an outside of the spray hole 271.

On the contrary, in the case that the mist sprayed from the spray hole 271 should be coated with a small area, a diameter of the spray hole 271 may be small. In the case that a density of the mist sprayed from the spray hole 271 is high, an inner circumference surface of the spray hole 271 is inclined so that an inner diameter of the spray hole 271 decreases as it goes toward an outside of the spray hole 271 or a difference between the inner diameter at the inside of the spray hole 271 and the inner diameter at the outside of the spray hole 271 is low.

As shown in drawings, a diameter of one side of the needle 30 may decrease as it goes toward an end portion of the needle 30.

A discharging hole 243 where one side of the needle 30 is inserted is formed at the valve sheet 24. A discharging pipe 242 is formed at one side of the valve sheet 24 and protrudes toward the spray hole 271. A shape of the discharging hole 243 corresponds to the one side of the needle 30. As shown in FIG. 7 and FIG. 8, when the one side of the needle 30 is inserted into the discharging hole 243, the discharging hole 243 may be blocked by the needle 30.

The valve sheet holder 25 is for fixing the valve sheet 24 to the valve frame 23. The valve sheet 24 and the valve sheet holder 25 may be integrally formed to be a single body in some cases. Selectively, the valve frame 23 and the valve sheet holder 25 may be integrally formed to be a single body.

The storage tank 28 stores a spray liquid (not shown in drawings) that is sprayed as a mist type by using the airbrush 1. A storage space 287 for storing the spray liquid is formed inside the storage tank 28. An out ret 288 for discharging the spray liquid stored in the storage space 287 is formed at a lower side of the storage tank 28.

The storage tank 28 is disposed at the upper side of the valve frame 23, and the outlet 288 is connected to a stagnant recess 231 formed at the upper side of the valve frame 23 in a downward direction. In this instance, a sealing member 289 is interposed between an edge of the stagnant recess 231 and an outer circumference surface of the outlet 288, and thus, the spray liquid can be prevented from being leaked between the storage tank 28 and the valve frame 23.

As shown in drawings, the needle 30 penetrates through the stagnant recess 231. A discharging hole 232 is formed at the lower side of the stagnant recess 231 toward the one side of the needle 30, and the discharging hole 232 extends to a central portion of the valve sheet holder 25.

The discharging hole 232 extended to a spray-liquid channel 241 and a discharging hole 243 formed at the valve sheet 24. When the one side of the needle 30 is not inserted into the spray-liquid channel 241 and the discharging hole 243, the spray liquid flows the discharging hole 243 through the discharging hole 232 and the spray-liquid channel 241.

In this instance, the spray-liquid channel 241 formed inside the discharging pipe 242 has a diameter being able to smoothly flow the spray liquid to the discharging hole 243 through a capillary phenomenon. However, since the diameter of the spray-liquid channel 241 where the capillary phenomenon is generated may be varied depending on viscosity of the spray liquid. Thus, the diameter of the spray-liquid channel 241 is selected with consideration for the viscosity of the spray liquid to be used.

An air-supplying passage 233 is formed at the valve frame 23. The air-supplying passage 233 is a passage where the compressed air flows when the compressed air inflows through the air-supplying hole 222. The compressed air inflowing through the air-supplying passage 233 flows toward the spray hole 271 through the air-supplying passage 233.

A spray cap 26 is coupled between the valve sheet 24 and the spray hole 271, that is, at a portion of the valve frame 23 facing the spray hole 271. The spray cap 26 has a shape surrounding the discharging pipe 242 formed at the valve sheet 24, and an interval is formed between an inner circumference surface of the spray cap 26 and an outer circumference surface of the valve sheet 24 to form an air-supplying passage 261.

Therefore, the compressed air inflowing to the air-supplying passage 233 formed at the valve frame 23 flows to the air-supplying passage 261 formed between the valve sheet 24 and the spray cap 26.

An orifice member 262 that an end of the discharging pipe 242 penetrates through is formed at a central portion of the spray cap 26. A cross-section area of the air-supplying passage 261 gradually decrease as it goes toward the orifice member 262. Thus, during the compressed air flowing through the air-supplying passage 233 and the air-supplying passage 261 is discharged to the spray hole 271 through the orifice member 262, a velocity of the compressed air largely increases and a pressure of the compressed air decreases.

Therefore, when the spray liquid Is discharged through the discharging hole 243, if the compressed air is sprayed with a very high velocity of flow through the orifice member 262, the spray liquid is dispersed by air current of high velocity and is sprayed with a mist type through the spray hole 271. This will be described later with reference to FIG. 9 and FIG. 10.

For reference, if there is an interval between the air-supplying hole 222 and the air-supplying passage 233 formed at the air-supplying pipe 221, the compressed air may be leaked through the interval. Accordingly, a connection tube 223 may be interposed between the bead frame 22 and the valve frame 23. The connection tube 223 makes the compressed air that flowed into the air-supplying hole 222 smoothly flow into the air-supplying passage 233.

In this instance, in order to enhance of assemblability of the head frame 22 and the valve frame 23, the connection tube 223 may be formed of a flexible material. That is, when the connection tube 223 is flexible, the air-supplying hole 222 and the air-supplying passage 233 can be connected without a leakage of the compressed air even though there is a tolerance between the head frame 22 and the valve frame 23.

A needle-supporting hole 234 is formed at the valve frame 23. The needle-supporting hole 234 is parallel to the needle 30 to support the other portion of the needle 30 that is positioned at an opposite side of the discharge hole 232 on the base of the stagnant recess 231. The needle-supporting hole 234 has a diameter for allowing the needle 30 to smoothly flow in the longitudinal direction and supports the Other portions of the needle 30. In this instance, a central portion and the other side of the needle 30 may have a uniform diameter A needle holder 31 is coupled to a portion of the valve frame 23 opposite to the spray hole 271, that is, the other end portion of the needle 30. In this instance, the other side of the needle 30 is fixed to and coupled to the needle holder 31, and the needle holder 31 is movably coupled in a direction parallel to a longitudinal direction of the needle 30 with respect to the valve frame 23 by a sliding.

To this, a sliding protrusion 311 protrudes at a central portion of the needle holder 31, and a sliding groove 235 where the sliding protrusion 311 is inserted and is movably coupled and slid is formed at the valve frame 23.

Therefore, when the needle holder 31 slides and moves in the direction parallel to the longitudinal direction of the needle 30 with respect to the valve frame 23, the one side of the needle 30 also moves together with the needle holder 31. That is, the needle 30 moves forward and goes back in the spray-liquid channel 241 according to the sliding movement of the needle holder 31.

When the needle holder 31 slides and moves toward the one side of the needle 30, the side of the needle 30 blocks the spray-liquid channel 241 and the discharging hole 243, and thus, the flow of the spray liquid through the spray-liquid channel 241 is blocked.

On the contrary, when the needle holder 31 slides and moves toward the other side of the needle 30, the one side of the needle 30 goes back into the inside of the spray-liquid channel 241 and an interval is formed between a portion of the one side of the needle 30 which diameter gradually decreases and the inner circumference surface of the spray-liquid channel 241. Thereby, the spray liquid discharged through the outlet and stored in the stagnant recess 231 flows into the discharging hole 243 via the spray-liquid channel 241.

A sealing ring 233 and a support ring 237 are disposed inside the sliding groove 235 formed at the valve frame 23. The sealing ring 236 is for sealing between an outer circumference surface of the sliding protrusion 311 and an inner circumference surface of the sliding groove 235. The sealing ring prevents the spray liquid flowing into the sliding groove 235 through the needle-supporting hole 234 from being leaked to an outside through a fine gap between the needle holder 31 and the valve frame 23.

The support ring 237 fixes the sealing ring 236 so that a position of the sealing ring 236 is hot changed, and the support ring 237 is fixed to and coupled to the valve frame 23.

The spray-liquid channel 241 and the discharging hole 243 can be open or blocked by the one end of the needle 30 according to the movement of the needle 30, and thus, the valve sheet 24 and the needle 30 form a kind of a needle valve.

As shown in drawings, a hooking projection (a hooking jaw) 312 is formed at an edge of the needle holder 31.

The trigger 33 includes a trigger body 331 having a bar shape. At the trigger body 331, a button-coupling protrusion 332, a lever-operating protrusion 333, and an air-supplying-operation protrusion 334 are formed. The button-coupling protrusion 332 protrudes in an upward direction. The lever-operating protrusion 333 protrudes from the trigger body 331 toward the spray hole 271. The air-supplying-operation protrusion 334 penetrates through a bottom surface of the head frame 22, protrudes in a downward direction, and is inserted into the operation hole 111.

The trigger body 331 of the bar shape is supported by the head frame 22 so that the trigger body 331 moves in an upward direction and in a downward direction by a sliding. Selectively, the trigger body 331 may be supported by a head cover 21, which will be described later. This may be varied as necessary.

The spray button 35 may be coupled to the button-coupling protrusion 332. The spray button 35 enhances an appearance of the airbrush 1. Also, the user easily operates the airbrush 1 by applying a force to an upper end of the trigger body 331 through pressing the spray button 35. The spray button 35 and the button-coupling protrusion 332 may be integrally formed to form a single body, as necessary.

The rotation axis 341, the holder-operating rib 342, and the lever 343 are formed at the holder-operating member 34. A hooked recess (a hooked groove or a hooked indentation) 344 having a shape corresponding to the needle holder 31 is formed at the holder-operating rib 342. As shown in drawings, the hooking projection 312 is inserted into and connected to the hooked recess 344.

Although it is not shown in detail, the rotation axis 341 protrudes to both sides of the holder-operating member 34, and both ends of the rotation axis 341 is rotatably supported by the head frame 22. That is, the holder-operating member 34 is supported by the head frame 22 to be rotated with respect to the rotation axis 341.

The lever 343 protrudes to one side Of the holder-operating member 34, and one side of the lever 343 is connected to the rotation axis 341 and the other side of the lever is in contact with the lower side of the lever-operating protrusion 333.

The elastic member 32 is mounted to elastically support the needle holder 31 toward the spray hole 271. To this, one end of the elastic member 32 is in contact with the needle holder 31, and the other end of the elastic member 32 is supported by the head frame 22 or the head cover 21, which will be described later.

Therefore, the needle holder 31 is supported by the elastic member 32 so that the needle valve is blocked, that is, the one side of the needle 30 is positioned at a position to block the spray-liquid channel 241 and the discharging hole 243.

As stated in the above, the needle holder 31 is positioned at a portion which is nearest to the discharging hole 243 by the elastic force of the elastic member 32 within a range where the needle holder 31 can be positioned by the sliding with respect to the valve frame 23.

In this instance, as shown in FIG. 7, by the connection of the hooking projection 312 and the hooked recess 344, the holder-operating member 34 is positioned so that the other end portion of the lever 343 is positioned at the uppermost position within a range where the other portion of the lever 343 can be positioned. The lever-operating protrusion 333 is supported by the other end of the lever 343, and thus, the trigger body 331 is also positioned at the uppermost position within a range where the trigger body can be positioned.

Therefore, the spray button 35 coupled to the button-coupling protrusion 332 of the trigger body 331 is positioned at the uppermost position within a range where the spray button 35 can be positioned by the elastic force of the elastic member 32 that is delivered through the above path.

For reference, the lower end portion of the air-supplying-operation protrusion 334 inserted into the operation hole 111 is positioned at a position not pressing the driving button 172 of the switch 171.

As such, at the state shown in FIG. 7 and FIG. 8, the air pump 151 of the airbrush 1 does not work and thus the compressed air is not discharged to the orifice member 262, and the spray liquid discharged through the discharging hole 243 and stored in the stagnant recess 231 does hot flow into the discharging hole 243 because the spray-liquid channel 241 is blocked by the one side of the needle 30.

Also, the light emitting device (not shown in drawings) of the lighting member 19 is also maintained off.

Figure 9:
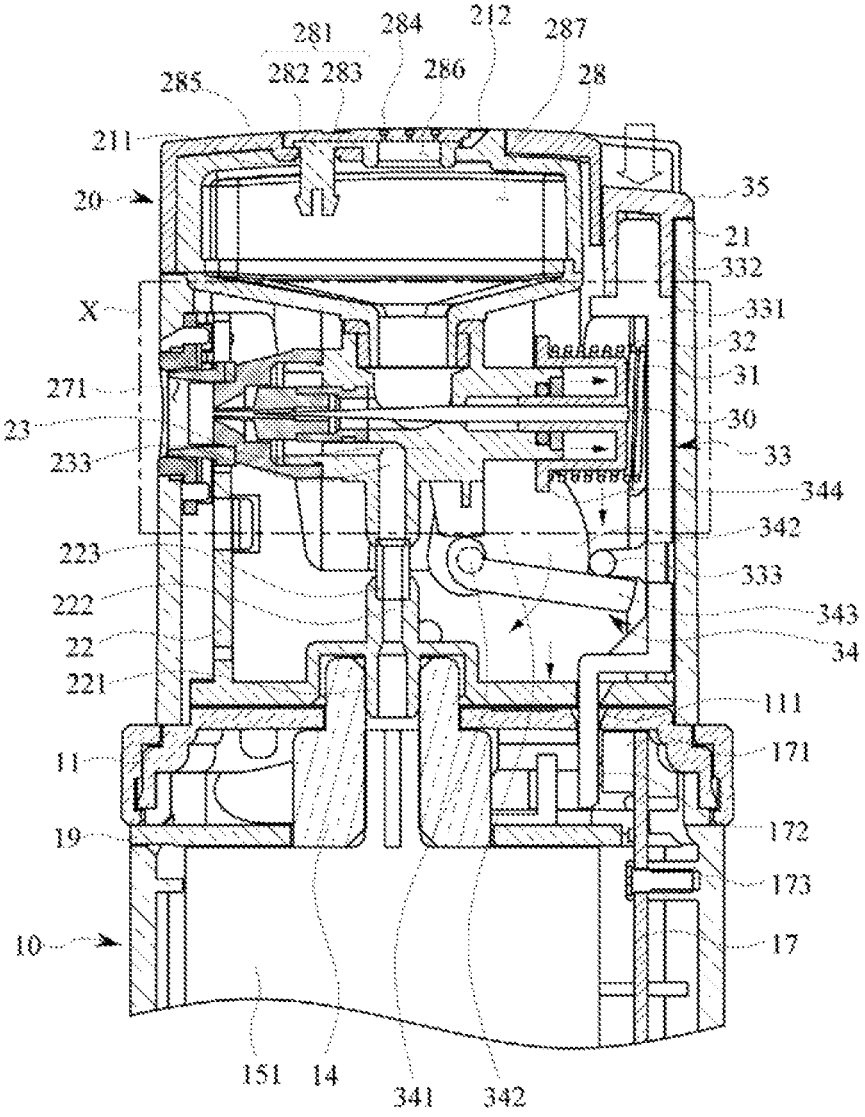
FIG. 9 is a longitudinal cross-section view of a part of the air-supply module and the spray head when the airbrush shown in FIG. 1 operates.
Figure 10:
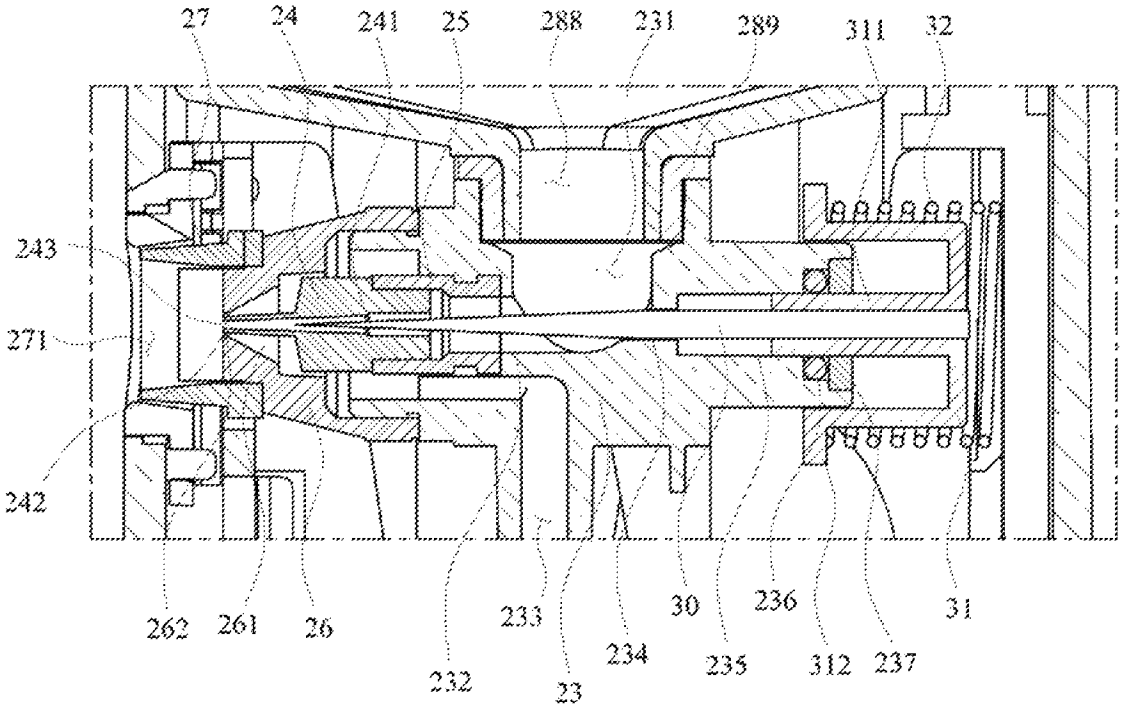
FIG. 10 is an enlarged view of an X portion of FIG. 9.

FIG. 9 is a longitudinal cross-section view of a part of the air-supply module and the spray head when the airbrush shown in FIG. 1 operates, and FIG. 10 is an enlarged view of an X portion of FIG. 9. The airbrush 1 will be described with reference to FIG. 9 and FIG. 10, along With FIG. 6.

With reference to FIG. 6, FIG. 9, and FIG. 10, when the user applies a force to the spray button 35 in a direction of arrow in order to operate the airbrush (the reference numeral 1 of FIG. 1) and thus the spray button 35 moves in the downward direction, the airbrush 1 operates.

Because the spray button 35 moves in the downward direction, the trigger body 331 moves in the downward direction. During the process, the lever 343 is pressed in the downward direction by the lever-operating protrusion 333, and the holder-operating member 34 rotates with respect to the rotation axis 341.

Accordingly, the hooking projection 312 connected to the hooked recess 344 of the holder-operating rib 342 moves toward the other side of the needle 30, that is, opposite to the spray hole 271, and the needle holder 31 slides and moves toward the other side of the needle 30 as shown in drawings.

By the sliding movements of the needle holder 31, the elastic member 32 is compressed, the one side of the needle 30 goes back from the spray-liquid channel 241 and the discharging hole 243, and the spray liquid is discharged to the discharging hole 243 through the spray-liquid channel 241.

Meanwhile, because the trigger body 331 moves in the downward direction, the air-supplying-operation protrusion 334 is inserted into the operation hole 111 and an end of the air-supplying-operation protrusion 334 presses the driving button 172 of the switch 171.

When the driving button 172 of the switch 171 is pressed, the electric power of the battery 16 is supplied to the air-supply unit 15, and thus, the compressed air is discharged from the air pump 151. The compressed air sequentially flows through the air-supplying hole 222 and the air-supplying passages 233 and 261 and spurted or sprayed with a high velocity through the orifice member 262.

In this instance, the spray liquid discharged through the discharging hole 243 as stated in the above is dispersed by the compressed air spurted or sprayed with the high velocity through the orifice member 262, and the spray liquid of the mist type is sprayed to an outside of the spray head 20 through the spray hole 271.

As such, the trigger 33 supported by the elastic force of the elastic member 32 moves in the downward direction only by an operation of the user of pressing the spray button 35. Thus, the needle valve formed by the valve sheet 24 and the needle 30 and the switch 171 are simultaneously operated, and thus, the spray liquid stored in the storage tank 28 is sprayed with the mist type.

On the contrary, when the user applies the force to the spray button 35, a shape of the elastic member 32 is recovered by the elastic force of the elastic member 32 and thus the needle valve is blocked and the operation by the switch 171 is stopped. Accordingly, the airbrush 1 is recovery in the state described with reference to FIG. 7 and FIG. 8. Accordingly, the operation of the airbrush 1 is stopped.

That is, the operation and the stop of the airbrush 1 are performed by only one operation of pressing the spray button 35, and therefore, the leakage of the spray liquid or unnecessary operation of the air-supply unit 15 can be prevented.

Accordingly, usability of the airbrush 1 can be enhanced. Also, the unnecessary leakage of the spray liquid can be prevented, and waste of the spray liquid can be minimized, and also, hygiene can be improved. Further, the consumption of the electric power of the battery 16 can be minimized, and the portability of the airbrush 1 can be enhanced.

On the other hand, the head cover 21 that was stated in the above is a portion of forming an outer shape of the spray head 20. Thus, the head cover 21 covers the head frame 22, the valve frame 23, the storage tank 28, the trigger 33, the holder-operating member 34, and so on, and enhances an appearance of the spray head 20.

When the spray liquid stored in the storage space 287 of the storage tank 28 is used all of it, the spray liquid may be injected to the storage space 287.

To this, an inlet 286 for injecting the spray liquid is formed at an upper side of the storage tank 28. When the airbrush 1 is carried and moved in the state that the inlet 286 is open, the spray liquid may be discharged to the outside of the spray head 20 through the inlet 286 or the spray liquid may be dried.

Therefore, an inlet cover 281 may be openably mounted oh the inlet 286. As the inlet cover 281, inlet covers of various structures enabling to seal the inlet 286 may be used. As an example, the inlet cover 281 shown in drawings will be described as follows.

The inlet cover 281 includes a rotation-supporting pin 282 and a cover body 283, and a vent hole 284 is formed at the cover body 283.

Pin holes 285 and 211 are formed at the upper side of the storage tank 28 and the head cover 21 for covering the same, respectively. The pin holes 285 and 211 have diameters corresponding to a diameter of the rotation-supporting pin 282. The rotation-supporting pin 282 may be rotatbly inserted into and coupled to the pin holes 285 and 211. Also, a cover-mounting recess 212 where the cover body 283 is mounted may be formed at the upper side of the head cover 21.

Therefore, when the user wants to inject the spray liquid into the storage tank 28, the user separates the cover body 283 from the cover-mounting recess 212, rotates the inlet cover 281 with respect to the rotation-supporting pin 232 to expose the inlet 286, and injects the spray liquid into the storage space 287 through the inlet 286 that is exposed.

The vent hole 284 allows an outside air to flow into the storage space 287. That is, when the airbrush 1 is operated and thus the spray liquid stored in the storage space 287 flows into the discharging hole 243 via the stagnant 231 and the spray-liquid channel 241, the outside air flows into the storage space 287 through the vent hole 284 with ah amount the same as an amount of the spray liquid discharged from the storage space 287. Thus, the spray liquid can easily and smoothly flow.

However, if a diameter of the vent hole 284 is excessively large, the spray liquid may leak out to the outside through the vent hole 284. Thus, in order to prevent the leakage, the vent hole 234 may have a suitable diameter with consideration for a viscosity of the spray liquid.

If the ventilation between an inside and an outside of the storage space 287 through the vent hole 284 is generated for a longtime, the spray liquid may be dried.

In order to prevent the dry of the spray liquid, when the airbrush 1 does not operate for a long time, the protection cap 40 is coupled to the spray head 20 and thus the vent hole 284 is coved. Then, the spray liquid can be presented from being dried.

The inlet cover 281 may be formed of a flexible material or an elastic material to easily open and block the inlet cover 281.

For reference, although it is not shown, the inlet cover 281 may be coupled to the head cover 21 by being detachably inserted into the inlet 286 so that the cover body 283 can open and block the inlet 286 without the rotation-supporting pin 282 and the pin holes 211 and 285. As another example, a part of the cover body 283 may be coupled to the cover-mounting recess 212 formed at the bead cover 21. In this case, when the inlet 286 is wanted to be open, the other side of the cover body 233 is pulled, and then, the cover body 283 is elastically deformed and the inlet 286 can be open.

Meanwhile, in order to spray various kinds of the spray liquids by using the airbrush 1, a plurality of spray heads 20 storing various kinds of the spray liquids, respectively, are used. More particularly, the airbrush 1 is operated after one of the plurality of spray heads 20 may be selected and may be coupled to the airbrush 1 according to the necessary. Then, each of various kinds of the spray liquids can be sprayed by the airbrush 1.

Accordingly, by the airbrush 1 according to the embodiment of the present invention, the various kinds of the spray liquids can be easily selected and used on purpose. The, usability of the airbrush 1 can be enhanced.

Although an airbrush according to an embodiment of the invention is described in the above, the invention is not limited to the embodiment stated in this specification. In addition, another embodiment may be easily suggested through an addition, a modification, a deletion, or so on of an element in the scope and spirit of the invention by those skilled in the art. Thus, the addition, the modification, the deletion, or so on can be included in the scope and spirit of the invention.

Descriptions of Reference Numerals

| | |
|---|---|
| 1: an airbrush | 10: an air-supply module |
| 11: an upper cover | 111: an operation hole |
| 112: a fastening hole | |
| 114: a protrusion-supporting hole | |
| 12: an air-supply module frame | 121, 122: a supporting rib |
| 13: a lower cover | 14: a connection pipe |
| 141: a fastening hole | 15: an air-supply unit |
| 151: an air pump | 152: a motor |
| 16: a battery | 17: a circuit board |
| 171: a switch | 172: a driving button |
| 173, 174: fixing members | 175: a charging lamp |
| 176: a connector | 19: a lighting member |
| 20: a spray head | 21: a head cover |
| 211: a pin hole | |
| 212: a cover-mounting recess | |
| 213: a hooking protrusion | 22: a head frame |
| 221: an air-supplying pipe | 222: an air-supplying hole |
| 223: a connection tube | |
| 224: a supporting protrusion | |
| 23: a valve frame | 231: the stagnant recess |
| 232: a discharging hole | |
| 233: an air-supplying passage | |
| 234: a needle-supporting hole | 235: a sliding groove |
| 236: a sealing ring | 237: a support ring |
| 24: a valve sheet | |
| 241: a spray-liquid channel | |
| 242: a discharging pipe | 243: a discharging hole |
| 25: a valve sheet holder | 26: a spray cap |
| 261: an air-supplying passage | 262: an orifice member |
| 27: a spray ring | 271: a spray hole |
| 28: a storage tank | 281: an inlet cover |
| 282: a rotation-supporting pin | 283: a cover body |
| 284: a vent hole | 285: pin hole |
| 286: an inlet | 287: a storage space |
| 288: an outlet | 289: a sealing member |
| 30: a needle | 31: a needle holder |
| 311: a sliding protrusion | 312: a hooking projection |
| 313: a sealing ring | 314: a support ring |
| 32: an elastic member | 33: a trigger |
| 331: a trigger body | |
| 332: a button-coupling protrusion | |
| 333: a lever-operating protrusion | |
| 334: an air-supplying-operation protrusion | |
| 34: a holder-operating member | 341: a rotation axis |
| 342: a holder-operating rib | 343: a lever |
| 344: a hooked recess | 35: a spray button |
| 36: a separation button | |
| 361: a fastening hook | |
| 40: a protection cap | 50: a cradle |
| 51: a mounting recess | |

INDUSTRIAL APPLICABILITY

In an airbrush according to an embodiment of the present invention, electric power for operating an air-supply module is supplied from a battery which is embedded, and thus, potability of the airbrush can be enhanced. Also, a supply of a compressed air and a supply of a spray liquid can be controlled at the same time only using the spray button included in a spray head. Thus, an operation of an airbrush can be easy, and the spray liquid can be prevented from being leaked through a spray hole. Accordingly, a loss of the spray liquid can be minimized and the airbrush can be maintained clean. In addition, a spray head for storing the spray liquid can be easily replaced and the suitable spray liquid can be selected on purpose, and thus, usability of the airbrush can be enhanced. As a result, there is an industrial applicability.

The invention claimed is:

1. An airbrush comprising:

an air-supply module comprising a battery, an air-supply unit for discharging a compressed air when electric power is supplied, a switch for supplying or blocking the electric power of the battery to the air-supply unit, an upper cover for covering an upper side of the air-supply module, and a connection pipe, an end portion of the connection pipe being connected to the air-supply unit and the other end portion of the connection pipe penetrating through the upper cover and being exposed to an upper side of the air-supply module; and a spray head having a spray hole at one side of the spray head and detachably coupled to the air-supply module, wherein the spray head comprises:

a storage tank for storing a spray liquid;

a needle valve for discharging or blocking the spray liquid stored in the storage tank to a discharging hole formed at the spray hole;

a valve frame for supporting the needle valve, wherein the valve frame comprising an air-supplying passage where the compressed air flows and an orifice member being adjacent to the discharging hole and for spraying or spurting the compressed air that penetrated through the air-supplying passage to the spray hole; and a trigger for operating the needle valve and the switch at the same time, wherein the upper cover of the air-supply module has an operation hole where a lower portion of the trigger is inserted and wherein the switch is adjacent to the operation hole and an operation of the switch is determined according to a depth of the trigger inserted into the operation hole.

2. The airbrush according to claim 1, wherein the air-supply module further comprises:

a circuit board electrically connected to the air-supply unit, the battery, and the switch; and a lighting member including a light emitting device electrically connected to the circuit board and disposed at a side of the airbrush where the spray hole is formed, wherein the light emitting device being turned on or off according to an operation of the switch.

3. The airbrush according to claim 2, wherein the air-supply module further comprises:

a connector electrically connected to the circuit board, wherein a jack supplying charging electric power and being detachably coupled to the connector;

a charging circuit disposed at the circuit board, wherein the charging circuit for supplying the charging electric power to the battery to charge the battery; and a charging lamp electrically connected to the circuit board and displaying a charging state of the battery by the charging circuit.

4. The airbrush according to claim 1, wherein the needle valve comprises:

a needle, wherein a diameter of the needle decreasing at one side of the needle toward an end portion of the needle; and a valve sheet having the discharging hole, wherein the one side of the needle being inserted and supported in the discharging hole, wherein the spray head comprises:

a head frame for movably supporting the trigger in upward and downward directions and for supporting the valve frame, wherein an air-supplying pipe for allowing the compressed air to flow to the air-supplying passage protruding from the head frame in a downward direction;

a needle holder where the other side of the needle is fixed, wherein the needle holder movably coupled to the valve frame in a direction parallel to a longitudinal direction of the needle and having a hooking projection;

an elastic member for elastically supporting the needle holder in a direction toward the spray hole; and a holder-operating member including a rotation axis, a lever for connecting the rotation axis and the trigger, and a hooked recess connected to the hooking projection, wherein both ends of the rotation axis being rotatably supported by the head frame, wherein the needle holder moving in the longitudinal direction of the needle when the trigger moves in upward and downward directions.

5. The airbrush according to claim 4, wherein the spray head further comprises:

a head cover for covering the head frame, the valve frame, the storage tank, and the trigger.

6. The airbrush according to claim 5, wherein the spray head further comprises:

a separation button of the spray head and the air-supply module, wherein an upper side of the separation button penetrating through an outer circumference surface of the head cover and being exposed to an outside and a lower side of the separation button including a fastening hook; and a button-supporting member disposed inside the head cover and elastically supporting the separation button so that the upper side of the separation button is exposed to the outside of the outer circumference surface of the head cover, and wherein a fastening hole is formed at an upper side of the air-supply module to correspond to the fastening hook.

7. The airbrush according to claim 5, wherein a hooking protrusion is formed at an outer circumference surface of the head cover, wherein the spray head further comprises:

a spray button coupled to an upper end of the trigger or formed at the upper end portion of the trigger; and a protection cap for covering the spray hole and the spray button, wherein the protection cap being detachably coupled to the spray head and having a hooked recess corresponding to the hooking protrusion at an inner circumference surface of the protection cap.

8. The airbrush according to claim 5, wherein an inlet where the spray liquid is injected is formed at an upper side of the storage tank, wherein the spray head further comprises an inlet cover for openably covering the inlet, and wherein the inlet cover has at least one vent hole.

9. The airbrush according to claim 8, wherein the inlet cover is formed of an elastic material, and wherein one side of the inlet cover is coupled to the head cover.

10. The airbrush according to claim 8, wherein a pin hole is formed at the upper side of the storage tank, and wherein the spray head further comprises a rotation-supporting pin rotatably inserted into the pin hole, and an inlet cover comprising a cover body, wherein the cover body covering the inlet and having at least one vent hole.

11. The airbrush according to claim 1, further comprising:

a cradle including a mounting recess having a shape corresponding to a lower end portion of the air-supply module and supporting the air-supply module upright.

* * * * *